US005218801A

United States Patent [19]

Hereford

[11] Patent Number: 5,218,801

[45] Date of Patent: Jun. 15, 1993

[54] ROOF TRUSS AND DECKING SYSTEM

[76] Inventor: Judson A. Hereford, Rte. 2, Box 3144A, Nacogdoches, Tex. 75961

[21] Appl. No.: 766,630

[22] Filed: Sep. 25, 1991

[51] Int. Cl.[5] ..... E04C 3/10; E04C 3/30

[52] U.S. Cl. ..... 52/223.9; 52/644; 52/693

[58] Field of Search ..... 52/227, 223 R, 223 L, 52/644, 693

[56] References Cited

U.S. PATENT DOCUMENTS

| | | | |
|---|---|---|---|
| 2,874,812 | 2/1959 | Clevett, Jr. | 52/227 |
| 3,918,222 | 11/1975 | Bahramian . | |
| 3,922,823 | 12/1975 | King . | |
| 4,187,652 | 2/1980 | Bobrovnikov . | |
| 4,275,537 | 6/1981 | Pinson . | |
| 4,294,051 | 10/1981 | Hughes . | |

FOREIGN PATENT DOCUMENTS

| | | | |
|---|---|---|---|
| 134523 | 10/1949 | Australia | 52/227 |

*Primary Examiner*—Carl D. Friedman
*Assistant Examiner*—Wynn E. Wood
*Attorney, Agent, or Firm*—Marvin J. Marnock

[57] ABSTRACT

A roof truss and decking system having trusses constructed with multiple truss blocks (8) stacked end to end with crush plates (14) in between. Keystones (16) are placed at the apex of the trusses or the crush plates (14) wedge shaped forming the trusses into arches. Truss blocks (8), keystones (16) and crush plates (14) are compressed together and strengthened with wire ropes (20). Wire ropes (20) run through wire rope receiving channels (30) in the truss blocks (8), through the curved wire rope receiving channels (46) in the keystones (16), and through wire rope slots (34) in the crush plates (14). Tensions of the wire ropes (20) are transmitted to the feet of the trusses at the tie plates (12). Tiebeam wire ropes (21) are added to each truss from the tie plate (12) on one foot to the tie plate (12) on the other foot preventing the truss' feet from spreading. The trusses are spaced apart and the spaced between is covered with spacer plates (10) resting in grooves (26) at the top of the truss blocks (8). And at the keystone (16) the spaces is covered with half spacer plates (11) resting in grooves (47) at the top of the keystone (16). Each truss rests upon the tie blocks (18) that rest upon the walls (24).

16 Claims, 7 Drawing Sheets

ROOF TRUSS AND DECKING SYSTEM

BACKGROUND-FIELD OF INVENTION

This invention relates to roof trusses and roof decking systems applied over compressed earth block walls, or other walls and specifically to a new roof system using primarily blocks of compressed earth or flyash with additives, and being post tensioned with wire ropes.

BACKGROUND-DISCUSSION OF PRIOR ART

Various forms of roof truss construction have been employed with wood, steel, tin, and concrete over the years with good success. However, the present roof truss constructions have a number of disadvantages:

(a) there are some areas where these roof materials are scarce or the cost is prohibitive to people needing the roofs, and this is especially true for wood;

(b) concrete roofs require a great degree of training to engineer and construct;

(c) steel beam roofs require cranes to position the trusses;

(d) the purlins and tin coverings are sensitive to high wind.

Another invention, U.S. Pat. No. 4,275,537 to Pinson Neal on 1981 Jun. 30, incorporates a system of tensioned tubes and tensioned cables centered in slotted wood members for supporting roof loads. The disadvantages of that system are the low compressibility of wood and limited ability to handle large loads.

Accordingly, several objects and advantages of may roof truss system using machine made compressed blocks are:

(a) earth at the building site can be used with a minimum amount of additives thereby reducing cost and the amount of material needed to be shipped to the building site;

(b) the entire roof deck can be erected by a work crew with no more than two days of training;

(c) only hand tools and scaffolding are necessary to assemble the roof;

(d) the weight and permanence of the roof provides excellent high wind resistance.

Still further objects and advantages will become apparent from a consideration of the ensuing description and drawings. The features of novelty which characterize the invention will be pointed out with particularity in the claims annexed to and forming a part of this specification.

SUMMARY OF THE INVENTION

The invention is roof truss and deck system comprised of individual compressed earth blocks held together with wire ropes. Truss blocks are positioned end upon end forming the roof rafters or arches. On one side, each truss block has a channel from end to end and extending and extending inward from a side of the block to a depth slightly more than one-half the width w of the block to contain the wire rope. The blocks in each rafter of a truss are alternately arranged such that the channels in each truss block is in s side thereof which faces in opposite direction to that faced by the channelled side of each next adjacent truss block. A keystone is placed at the apex of each roof truss where the pitched rafters join. The arched roof does not use a keystone. Crush plates are sandwiched between each truss block and between the keystone and truss blocks. Crush plates are also sandwiched between each truss block for the arched roof truss. One wire rope with threaded terminations is run through the wire rope channels of each truss block from the foot of the first rafter through the keystone at the apex to the foot of the second rafter. Tie plates are positioned on the foot of the rafters allowing the threaded wire rope terminations to pass through a hole in the tie plates. Nuts are threaded onto the protruding wire rope terminations and used to tension the wire ropes making a rigid truss. A second wire rope acting as the tiebeam is run the span of the truss horizontally from one tie plate to the second tie plate. The terminations of the second wire rope are threaded with a nut and enough tension is applied to prevent spreading of the truss feet. The truss rests upon tie blocks that are sloped on top to match the slope of the truss. Also the tie block has a channel to allow the tiebeam wire rope to pass through the tie block.

Other alternatives exist for providing the tension necessary. Instead of threaded terminations, clamps can be used to hold the wire rope after being tensioned by some other device. Wire rope is just one possibility and can easily be replaced with metal tubing, metal strap, or even fiber glass.

The upper surface of the roof truss forms a part of the roof deck surface that a waterproof roof coating is attached to. The trusses are separated and spaced by the spacer plates which fill in the space between the trusses and completes the roof deck ready to receive a waterproof coating. The roof truss blocks, the keystone block, spacer plates, and tie blocks are made from common soil and additives adjusted to condition the available soil to obtain the necessary strength in these roof truss parts. Some of the more frequently chosen additives are portland type cement, clays, lignino sulphate and water. The four compressed soil and additives components of the roof truss system are made at the building site in a suitable brick making apparatus. The other required components, such as the wire rope with threaded terminations, the crush plates, the tie plates, and all of the soil additives are transported to the building site.

DRAWING FIGURES

DESCRIPTION OF THE PRESENT INVENTION

Figure 1:
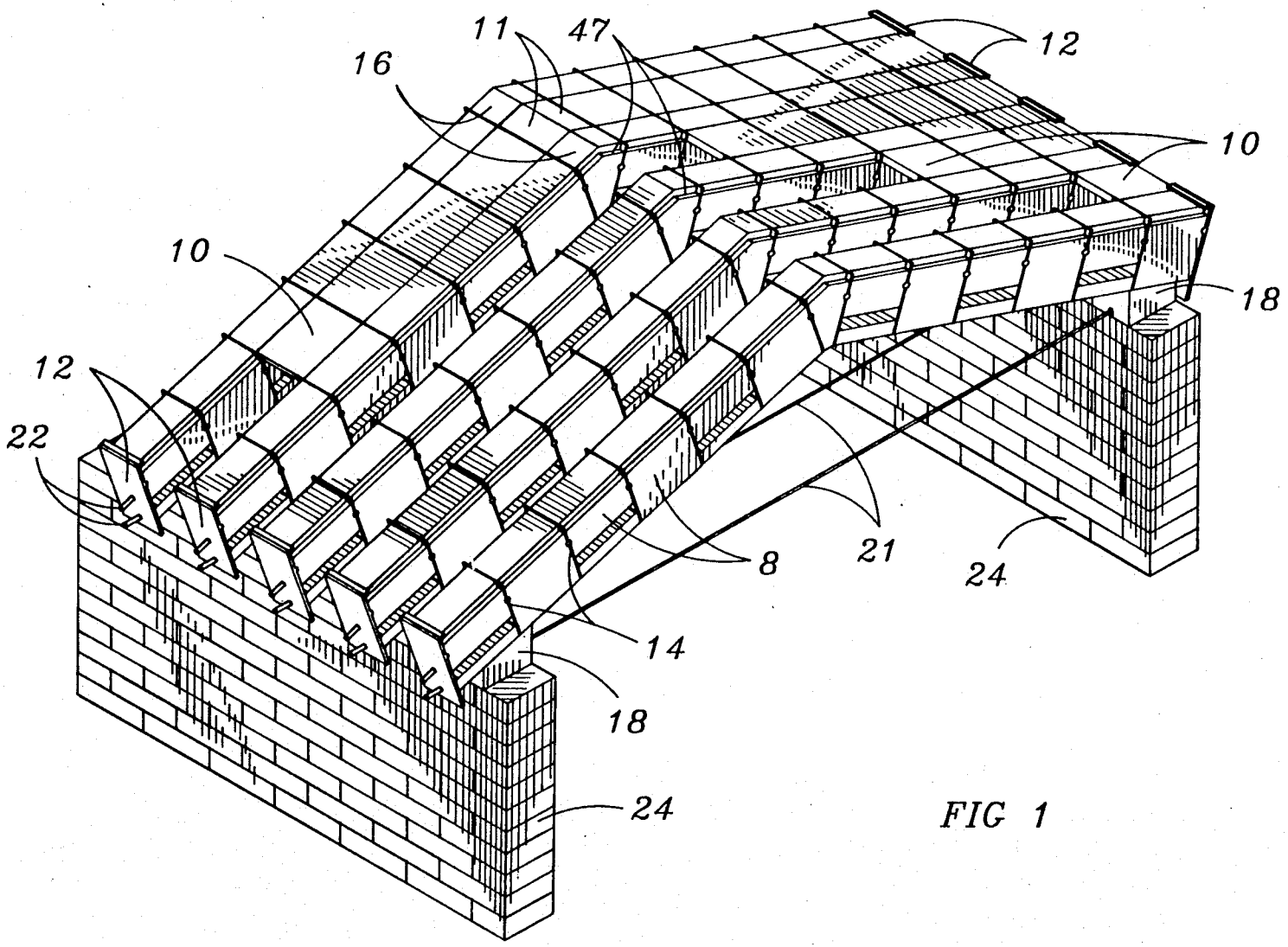
FIG. 1 is a perspective view of an assembled roof truss system with several spacer plates removed to show truss details.
Figure 4:
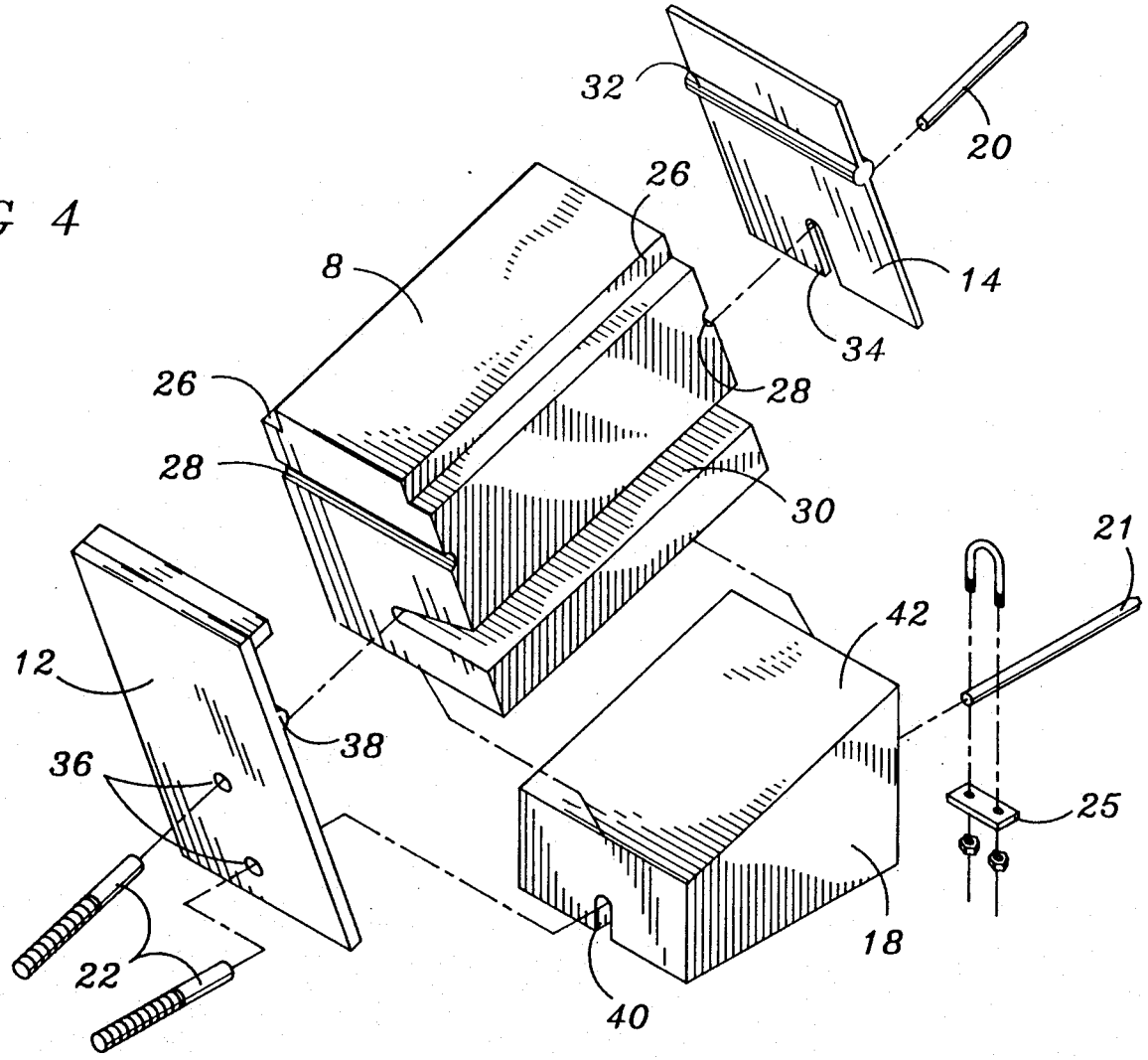
FIG. 4 is an isometric exploded view of one rafter end.
Figure 5:
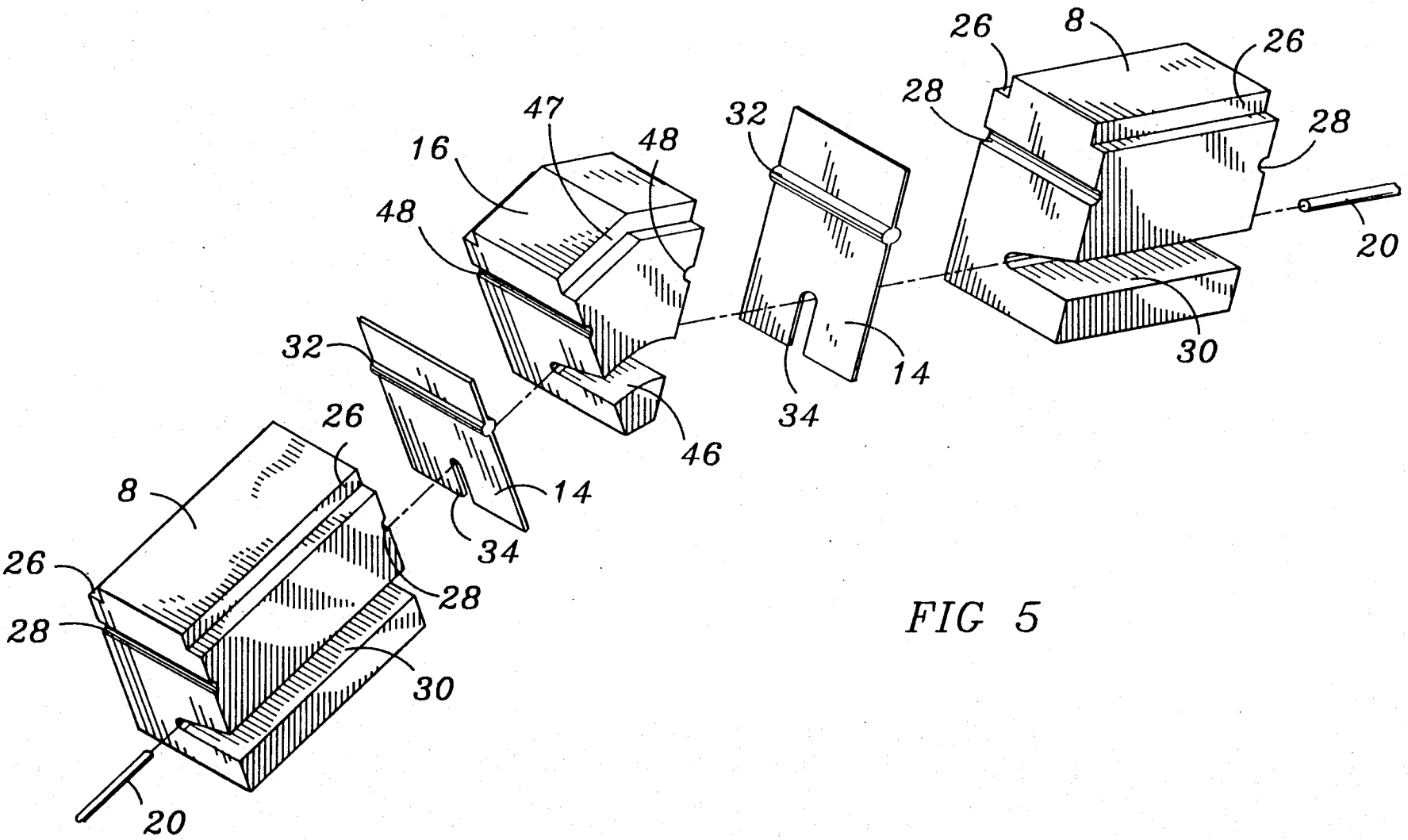
FIG. 5 is an isometric exploded view of a truss at the apex.

There is shown in FIG. 1 an assembled roof system comprising a plurality of roof trusses in position on tie blocks 18 that sets on walls 24. Also shown are components of the roof truss such as truss blocks 8 stacked end to end and provided with a wire rope receiving channel 30 in the side thereof for capturing a wire rope begin best shown in FIG. 2 and FIG. 4. Malleable crush plates 14, in FIG. 1, are sandwiched between each truss block 8 and between the truss blocks 8 and the keystones 16. At each truss apex keystones 16 provide the correct pitch. Metal or plastic tie plates 12 at the foot of each rafter provide stress distribution of the wire rope's tension over the end of the truss blocks 8. Tiebeam wire ropes 21 with a wire rope termination 22 on either end are run from the tie plate 12 on one side of the truss to the tie plate 12 on the other side of the truss. Spacer plates 10 are shown in position between trusses and resting on grooves 26 in the truss blocks 8 being best shown in FIG. 6. Half spacer plates 11 are shown between trusses and are resting on grooves 47 in the keystones 16 where the grooves are best shown in FIG. 5.

Figure 2:
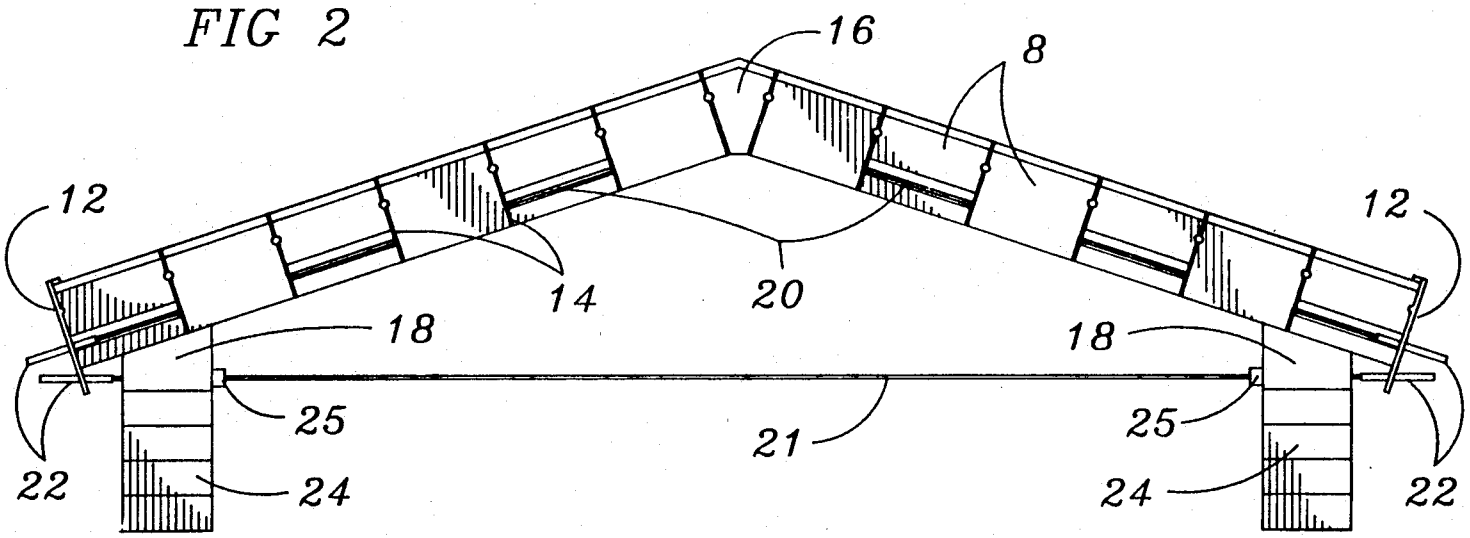
FIG. 2 is a side view of an assembled roof truss positioned on top of a wall.

There is shown in FIG. 2 an assembled roof truss with the blocks thereof arranged with the channel side of each block facing the opposite direction of the channel side of each adjacent block. Alternated truss blocks 8 are stacked end on end with crush plates sandwiched between each truss block 8 and between the keystone 16 and truss blocks 8. The apex of the truss is formed by the keystone 16. One wire rope 20 is run through the truss blocks 8, crush plates 14 and keystone 16. The ends of the wire rope 20 are terminated with threaded wire rope terminations 22 that protrude through the tie plate 12. A nut (not shown) on each threaded end of the wire rope terminations 22 is used to tension the wire rope 20 compressing the tie plates 12, crush plates 14, truss blocks 8 and keystone 16 together. The tiebeam wire rope 21 is used for a tiebeam from the foot of one rafter to the foot of the opposite rafter. The tiebeam wire rope 21 is terminated with threaded wire rope terminations 22 that protrude through the tie plate 12. The nuts (not shown) on the threaded ends of the wire rope terminations 22 are used to supply enough tension on the tiebeam wire rope 21 to prevent spreading of the rafter feet. The tie blocks 18 rest upon the wall 24 and support the roof truss. Tiebeam wire rope 21 runs through a channel in the tie blocks 18. A cable clamp 25, placed next to the inside of tie blocks 18, prevents inward movement of tie blocks 18.

Figure 3:
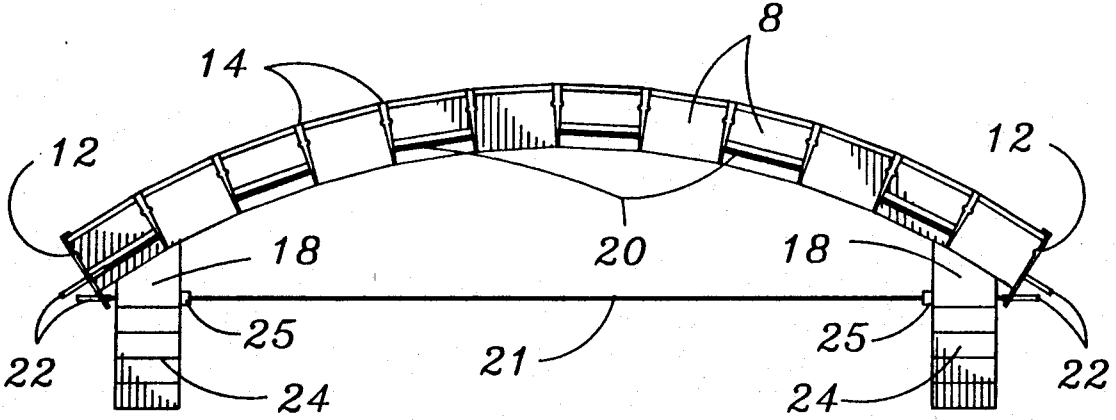
FIG. 3 is a side view of an assembled roof truss that is arched as an example of another embodiment.

There is shown in FIG. 3 an example of another embodiment of the roof truss. Truss blocks 8 have the same shape as used in FIG. 2. Crush plates 14 are tapered so that when sandwiched between truss blocks 8, the truss forms an arch. Tie plates 12 fit over the feet of the truss. A wire rope 20 runs through the truss blocks 8 and crush plates 14. The wire rope 20 is terminated with threaded wire rope terminations 22 protruding through the tie plate 12. The wire rope 20 is tensioned with a nut on the threaded wire rope terminations 22. Tiebeam wire rope 21 runs from one foot of the arched truss to the other foot and is terminated with threaded wire rope terminations 22. The tiebeam wire rope 21 is tensioned with nuts on each termination 22 with enough tension to prevent spreading of the truss feet. The roof truss rests upon the tie block 18 which rests upon the wall 24. The clamps 25 are tightened onto tiebeam wire rope 21 flush with the inside face of the tie block 18 preventing the tie block 148 from moving inward. As best shown in FIG. 4, the tie block 18 has a wire rope receiving channel 40 allowing the tiebeam wire rope 21 to run beneath the tie block 18.

There is shown in FIG. 4 one rafter end. A wire rope 20 runs through the crush plate 14, in the wire rope slot 34, through the truss block 8, in the wire rope receiving channel 30, and is terminated with the wire rope termination 22. The wire rope termination 22 protrudes through the wire rope termination hole 36 in the tie plate 12. The crush plate 14 has opposing convex aligning protrusions 32 on both sides. The crush plate 14 is made of a malleable material forming, under compression, to the surfaces of the truss blocks 8. The forming of the crush plate 14 ensures the maximum surface contact between the truss blocks 8 and prevents the uneven surfaces from over stressing small areas. On both ends of the truss block 8 are concave aligning channels 28. The concave aligning channels 28 on the truss block 8 mate with the convex aligning protrusions 32 of the crush plate 14. The convex and concave aligning system prevents slippage or twisting between mating truss blocks 8 or keystone blocks 16. The truss block 8 has a wire rope receiving channel 30 having a generally V-shape transverse cross section and curved at the vertex with the center of curvature coincident with a vertical plane passing through the center of the block and with a radius equal to the cross section radius of the wire rope. The plate 12 also has a convex aligning protrusion 38 that mates with the concave aligning channel 28 on the truss block 8. The wire rope termination holes 356 in the tie plate 12 permit the wire rope terminations 22 to protrude through after they are connected to the wire rope 20 and tiebeam wire rope 21. The tie plate 12 is made of rigid material to spread the tension of the wire rope 20 and tiebeam wire rope 21 over the end of the truss block 8. The tiebeam wire rope 21 runs through the tie block 18, in the wire rope receiving channel 40. The truss is supported by the tie block 18 on a mating sloped truss support surface 42. The clamps 25 are tightened onto tiebeam wire rope 21 flush with the inside face of the tie block 18 preventing the tie block 18 from moving inward. The above description is also true for the second or opposing foot of the truss.

There is shown in FIG. 5 the apex of a truss. A wire rope 20 runs through truss blocks 8, in the wire rope receiving channels 30, through the crush plates 14, in the wire rope slots 34, and through the keystone 16 in the curved wire rope receiving channel 46 that extends to the center line of the keystone 16. The curvature for the wire rope receiving channel 46 is such that the curve corresponds to and defines to the path of the wire rope as it enters and exits the channel. On both ends of the truss block 8 are concave aligning channels 28. The concave aligning channels 28 on the truss blocks 8 mate with the convex aligning protrusions 32 of the crush plate 14. Keystone 16 also has concave aligning channels 48 that mate with the convex aligning protrusions 32 on the crush plates 14. When the wire rope 20 is tensioned the truss blocks 8, crush plates 14 and keystone 16 are compressed together. The compression forces the rafter to conform to the angle of the faces on the keystone 16. The keystone 16 has on either side at the top grooves 47 for the half spacer plate 11 being best shown in FIG. 1.

Figure 6:
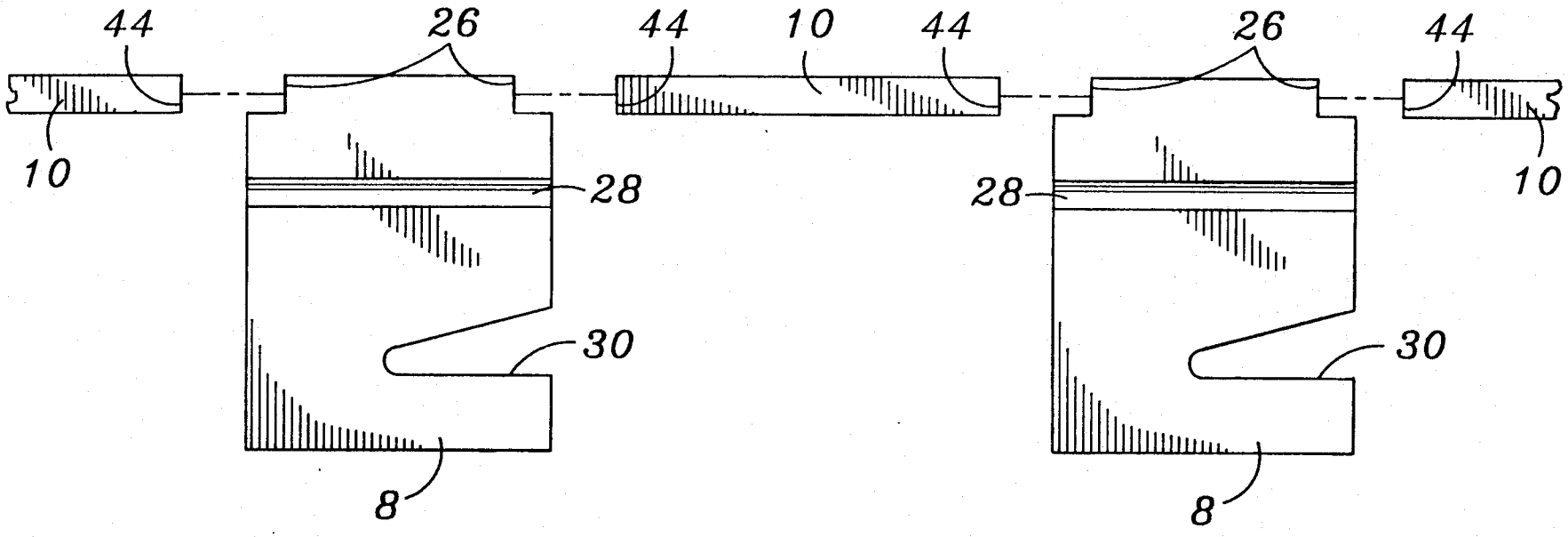
FIG. 6 is an exploded end view of truss ends showing spacer plate positions.

There is shown in FIG. 6 the end of two truss blocks 8. The wire rope receiving channel 30 is shown having a generally v-shaped transverse cross section, curved at its vertex the center of curvature disposed along a vertical plane through the longitudinal axis of the truss block 8. The wire rope receiving channel 30 is also shown with angled opening that better facilitates molding of the truss block 8. On both sides at the top of the truss block 8 are grooves 26 for the spacer plates 10 to rest.

Note that the crush plates 14 as shown in FIG. 5 do not have a corner notch for the spacer plate 10, but instead are left full at the corners to prevent the spacer plate 10 from sliding down the slope of the rafter. The contact side 44 of the spacer plate 10 shown in FIG. 6 fits into the grooves 26 of the truss block. The top surface of the truss block 8 and the top surface of the spacer plates 10 form a smooth roof deck ready to receive a water proof covering or roof tile.

Figure 7:
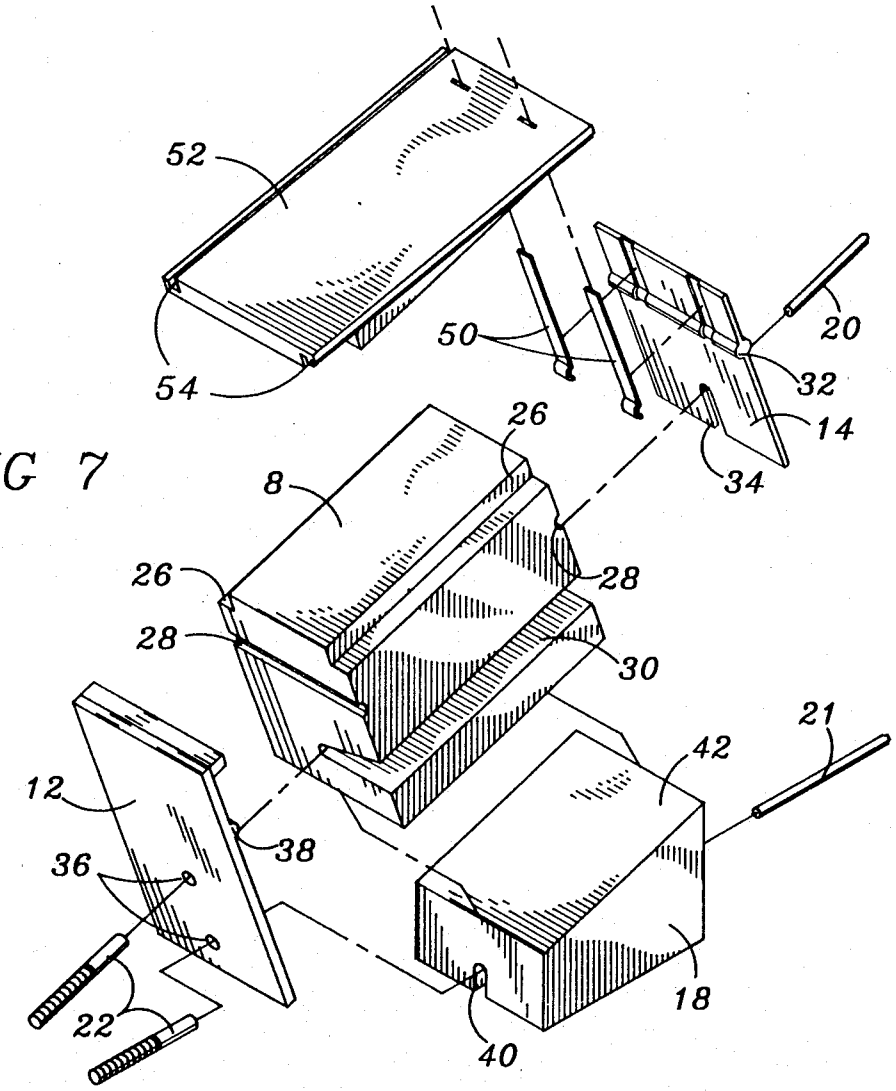
FIG. 7 is an isometric exploded view of one rafter end as an example of another embodiment including roof tiles.

As shown in FIG. 7 an alternative embodiment has a roof tile 52. The roof tile is connected to the roof deck by the crush plate tabs 50. The crush plate tabs 50 fit into the crush plate 14 that has been made to accept the crush plate tabs 50. When the crush plate 14 is sandwiched between truss blocks 8, the crush plate tabs 50 are captured. The top of the crush plate tabs 50 extend beyond the top of the truss block 8 and through the holes in a roof tile 52. The crush plate tabs 50 are folded over and lock in place a roof tile 52. Each roof tile locks into adjacent roof tiles with locking grooves 54.

Figure 7A:
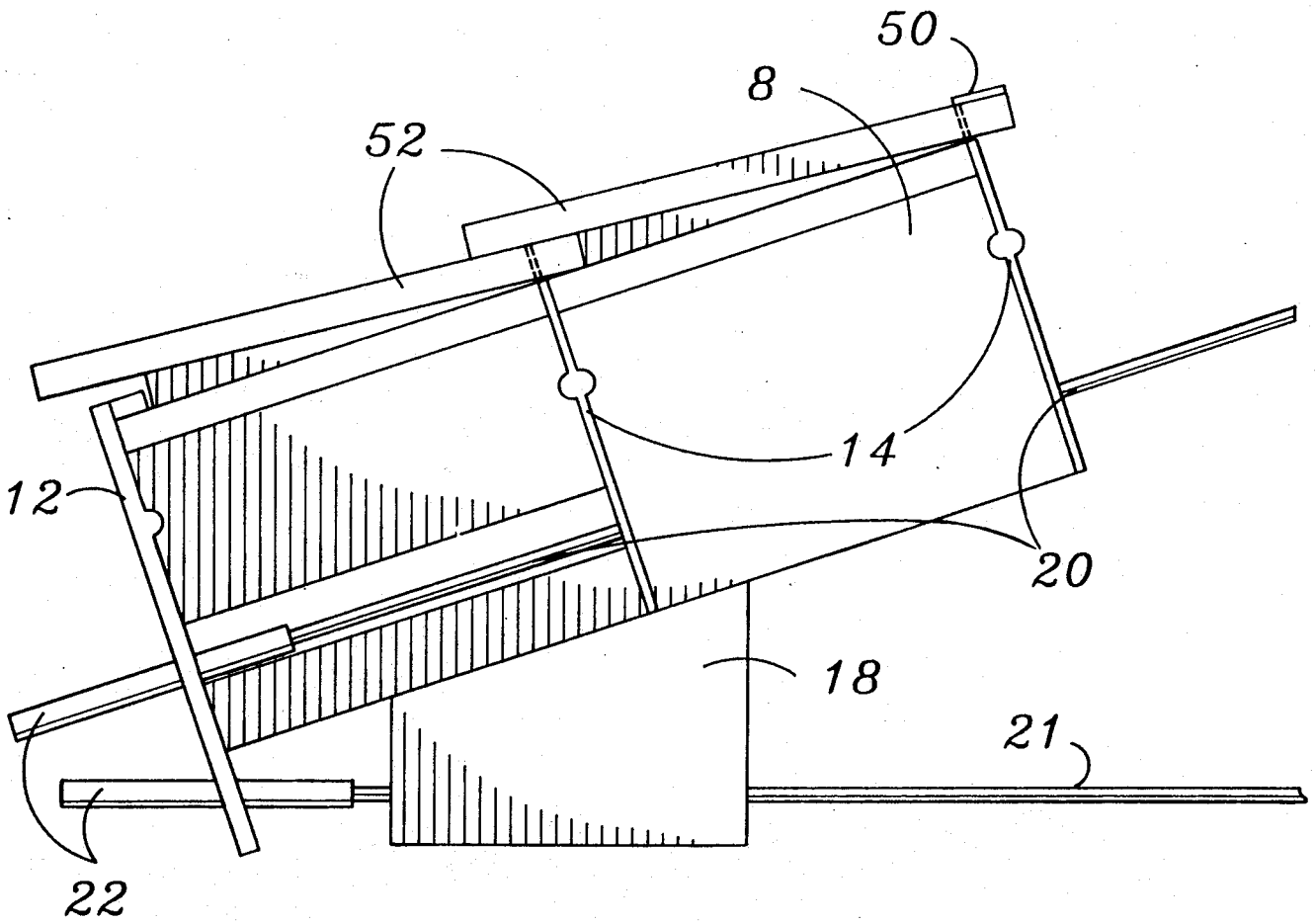
FIG. 7A is a side view of a roof truss in an alternative embodiment showing the position of the roof tiles.

As shown in FIG. 7A the roof tiles 52 overlap each other and are held in place by the crush plate tabs 50.

Operation

The roof trusses hold a load in the same way and reason as prestressed concrete. As shown in FIG. 2 truss blocks 8 are stacked end on end with a crush plate 14 between each. The crush plate 14 is manufactured with parallel faces allowing the truss blocks 8 to be stacked linearly. However, as shown in FIG. 3 the crush plates 15 can also be manufactured with a wedge shape allowing the truss blocks 8 to be stacked in a curved arch. Extending from side to side of the crush plates 14 are convex aligning protrusions 32 formed into the crush plate 14 being best shown in FIG. 4. The convex aligning protrusions 32 of the crush plates 14 mate with the concave aligning channel 28 of the truss blocks 8 stabilizing the truss and preventing slippage or twisting.

The truss blocks 8 in FIG. 2 are alternated with respect to orientation of their channel sides in order to capture the wire rope 20 inside the truss along a line in the vertical plane which passes through the longitudinal axes of the truss rafters. The keystone 16 at the apex of the truss has angled faces providing the pitch of the truss. Wire ropes 20 run through each truss from the foot of one rafter through each truss block 8, crush plate 14 and through the keystone 16 to the foot of the other rafter. As shown in FIG. 4, the wire rope 20 is terminated with threaded wire rope terminations 22 on both ends providing way to tension the wire ropes 20 with a nub. However, the wire ropes 20 and tiebeam wire ropes 21 can be tensioned with a hydraulic puller and then clamped into place. When the wire rope 20 is tensioned the resultant force is directly applied to the tie plates 12. The tie plates 12 distribute the force from the wire rope 20 over the end of the truss blocks 8. The tension of the wire rope 20 is converted into compressive force by the tie plate 12 compressing the truss blocks 8, crush plates 14 and the keystone 16 together. The compressive force acting on the truss provides sufficient strength to the truss for the roof loads.

The keystone 16 at the apex of the truss is best shown in FIG. 5. Wire rope 20 runs through the keystone 16 in the curved wire rope receiving channel 46 that extends inward of the keystone 16 to a depth corresponding to the depths of the channels 30. The curvature for the curved wire rope receiving channel 46 is such that it corresponds to and defines the path of the wire rope as it enters and exits the curved wire rope receiving channel 46. Like the truss blocks 8, the keystone 16 has concave aligning channels 48 extending from side to side that mate with the opposing convex aligning protrusions 32 on the crush plates 14. The keystone 16 has non-parallel ends forming a wedge shape. The angle between the ends is twice the angle of the roof pitch desired. When the wire rope 20 is tensioned the truss blocks 8, crush plates 14 and keystone 16 are compressed together. The compression forces the rafters to conform to the angel of the faces on the keystone 16.

To oppose the tendency of the truss feet to spread under load conditions, a tiebeam wire rope 21 is added to each truss as shown in FIG. 2. The tiebeam wire rope 21 is terminated with threaded wire rope terminations 22 at the tie plate 12 providing a way of tensioning the tiebeam wire rope 21. Enough tension is applied to the tiebeam wire rope 21 to prevent the spreading of the truss feet.

The truss is supported by the tie blocks 18 that wedge between the bottom of the truss and the top of the wall 24. The tie blocks 18 have a wire rope receiving channel 40 as shown in FIG. 4. The wire rope receiving channels 40 allow the tiebeam wire ropes 21 to pass freely underneath the tie blocks 18. Clamps 25 are tightened onto tiebeam wire rope 21 flush with the inside face of the tie block 18 preventing the tie block 18 from moving inward.

Now referring to FIG. 6, trusses are placed on tie blocks with sixteen inches from the center of one truss to the center of the next truss. The spaces between the truss blocks 8 of adjacent trusses are covered with spacer plates 10. The contact sides 44 of the spacer plates 10 mate with the grooves 26 which extends longitudinally in the truss blocks 8 and the groove sides of which join the top and side surfaces of the blocks. The spacer plate 10 is the same length as the truss block 8. The spacer plates 10 are held from sliding down the slope of the truss by the crush plates 14. As shown in FIG. 4, the crush plate 14 does not have a corner groove to match the groove 26 of the truss block 8. The extending portion of the crush plate 14 holds the spacer plate 10 from sliding down the slope of the truss. In a similar manner the keystones 16 in FIG. 1 have grooves 47 shown in FIG. 5 where the half spacer plates 11 rest. The crush plates 14 also hold the half spacer plates 11 from sliding down the slope of the truss.

The truss blocks 8, spacer plates 10, half spacer plates 11, tie blocks 18 and roof tiles 52 can be made of compressed soil and additives in a brick making apparatus as described in applicant's co-pending application, Ser. No. 07/636,726, filed Jan. 2, 1991, now U.S. Pat. No. 5,145,692.

In another embodiment, as shown in FIG. 7, crush plate tabs 50 are added to the crush plate to secure roof tiles 52 to the truss. Crush plate tabs 50 are made of malleable metal that is easily folded over the roof tile. 52. When the crush plate 14 is sandwiched between truss blocks 8, the crush plate tabs 50 are captured. The top of the crush plate tabs 50 extend beyond the top of the truss block 8 and though the holes in the roof tile 52. The crush plate tabs 50 are folded over and lock in place the roof tile 52. Each roof tile 52 locks into adjacent roof tiles with locking grooves 54. As shown in FIG. 7A the roof tiles 52 overlap each other end over end, and are held in place by the crush plate tabs 50.

Other embodiments are possible such as a door lintel. Although only three embodiments of the invention have been illustrated and described, it will be apparent to those skilled in the art that various changes and modifications may be made therein without departing from the spirit of the invention or from the scope of the appended claims.

I claim:

1. A roof structure incorporating a plurality of roof trusses in spaced relation, each said truss including a pair of rafters and a wedge-shaped keystone at the crown of the truss between the rafters, said keystone having tapered faces at opposite ends which extend in downwardly converging directions, and each said rafter includes:

a plurality of truss blocks arranged in end to end relationship, each said truss block having a pair of end faces, a pair of side faces and top and bottom surfaces, one of said rafters having a truss block at one end of the rafter which is disposed adjacent the keystone in face-to-face relation with a tapered face thereof and the other of said rafters having a truss block at one of its ends which is disposed adjacent the keystone in face-to-face relation with the other tapered face of the keystone, the other ends of said rafters defining the foot ends of the truss;

a plurality of crush plates, said crush plates each having parallel faces and said crush plates arranged such that a different one of said crush plates is sandwiched between each pair of adjacent truss blocks and between said keystone and its next adjacent truss blocks;

a pair of tie blocks, one of said tie blocks disposed beneath and engaging the bottom surface of the truss block superposed thereon at one foot end of the truss and the other tie block disposed beneath and engaging the bottom surface of the truss block superposed thereon at the other foot end of said truss, said roof trusses and tie blocks being adapted for placement atop the walls of a building with the rafters of each roof truss in substantially parallel relationship with the rafters of the next adjacent roof trusses;

a pair of tie plates, one of said tie plates being disposed at one end of the truss in face-to-face contact with the truss block and the tie block at said one foot end and the other tie plate being disposed in face-to-face contact with the truss block and tie block at said other foot end of the truss, each said truss block and said keystone having a channel in one side thereof extending inward a distance greater than one half of the width distance between the side faces of the truss block and said truss blocks being arranged such that the channeled sides of adjacent truss blocks face in opposite directions, each said crush plate having an opening therein which is in alignment with the channels formed in the truss blocks next adjacent thereto;

a tensioning member, each said tie plate having an opening therethrough for accommodating said tensioning member, said tensioning member extending through each opening in said tie plates, the channels formed in the truss blocks and keystone, and the openings in the crush plates;

first means for attaching the tensioning member to one of said tie plates;

second means for attaching the tensioning member to the other of said tie plates;

means for applying a tension force to said tensioning member to placed the truss blocks, crush plates and keystone under compression; and a tie beam connected to and extending between said tie blocks.

2. A roof structure a set forth in claim 1 further including a plurality of spacer plates, each mounted on and supported by adjacent roof trusses to fill the voids between the roof trusses and thereby provide a decking for the roof.

3. A roof structure as set forth in claim 1 wherein each truss block and said keystone are provided with grooves along edges of their top surfaces and said spacer plates are supported on one of the grooves in a roof truss of said roof structure and another of the grooves in the next adjacent roof truss of the roof structure.

4. A roof structure as set forth in claim 1 wherein each of said tie plates is provided with a second opening therethrough, each said tie block is provided with a channel in one face thereof which extends in the direction of the other of said tie blocks, and said tie beam is a second tensioning member which extends through the second openings in the tie plates and the channels in the tie blocks and said second tensioning member is provided with threaded end portions and means cooperative therewith for applying a tension force to said second tensioning member to prevent spreading of the rafters of each truss.

5. A roof structure as set forth in claim 4 further including a pair of clamps placed on said second tensioning member in abutting relation to the tie blocks, each said clamp abutting a different one of said blocks and clamping against a face thereof which faces the other of said tie blocks to restrict relative movement of the tie blocks.

6. A roof structure as set forth in claim 1 wherein said tensioning member is a wire rope.

7. A roof structure as set forth in claim 4 wherein both said tensioning members are wire ropes.

8. A roof structure as set forth in claim 1 wherein the tapered forces of the keystone face downwardly at respective angles which determine the slopes of the roof structure on both sides of the keystone.

9. A roof structure as set forth in claim 1 further including cooperable locking means on said crush plates and the next adjacent truss blocks for interlocking therewith to prevent said next adjacent truss blocks from slipping or twisting to one another.

10. A roof structure as set forth in claim 1 wherein each of said tie blocks has a sloping top surface which engages the bottom surface of the truss block superposed thereon and the slope of the sloping top surface matches the slope of the part of the roof truss which is on the same side of the keystone.

11. A roof structure as set forth in claim 2 wherein the roof structure with spacer plates is covered by a plurality of roof tiles, and each said crush plate is provided with tabs which extend from the crush plate above the top surfaces of the tiles and are folded over to lock a roof tile in place on the roof structure.

12. A roof structure as set forth in claim 9 wherein said cooperable locking means comprises a rib-like projection on each of the faces of each crush plate and a groove in the end face of each adjacent truss block, each said groove having a configuration conforming with that of the rib-like projection which is received therein.

13. A roof structure as set forth in claim 1 wherein the rafters and tie beam form a roof truss of triangular configuration with the tie beam constituting the base of the triangle.

14. A roof structure incorporating a plurality of roof trusses in spaced relation, each truss including a pair of rafters and a wedge-shaped keystone at the crown of the truss between the rafters, said ketystone having tapered faces at opposite ends which extend in downwardly converging directions, and each said rafter includes:

a plurality of truss blocks arranged in end to end relationship, each said truss block having a pair of end faces, a pair of side faces and top and bottom surfaces, one of said rafters having a truss block at one end of the rafter which is disposed adjacent the keystone in face-to-face relation with a tapered face thereof and the other of said rafters having a truss block at one of its ends which is disposed adjacent the keystone in face-to-face relation with the other tapered face of the keystone, the other ends of said rafters defining the foot ends of the truss;

a plurality of crush plates, said crush plates being of malleable material and arranged such that a different one of said crush plates is sandwiched between each pair of adjacent truss blocks and between said keystone and its next adjacent truss blocks;

cooperable locking means on each said crush plate and the truss blocks engaged therewith for preventing the engaged truss blocks from slipping and twisting relative to one another;

a pair of tie blocks, one of said tie blocks disposed beneath and engaging the bottom surface of the truss block superposed thereon at one foot end of the truss and the other tie block disposed beneath and engaging the bottom surface of the truss block superposed thereon at the other foot end of said truss, said roof trusses and tie blocks being adapted for placement atop the walls of a building with the rafters of each roof truss in substantially parallel relationship with the rafters of the next adjacent roof trusses;

a pair of tie plates, one of said tie plates being disposed at one end of the truss in face-to-face contact with the truss block and the tie block at said one foot end and the other tie plate being disposed in face-to-face contact with the truss block and tie block at said other foot end of the truss, each said truss block and said keystone having a channel in one side thereof extending inward a distance greater than one half of the width distance between the side faces of the truss block and said truss blocks being arranged such that the channeled sides of adjacent truss blocks face in opposite directions, each said crush plate having an opening therein which is in alignment with the channels formed in the truss blocks next adjacent thereto;

a tensioning member, each said tie plate having an opening therethrough for accommodating said tensioning member, said tensioning member extending through each opening in said tie plates, the channels formed in the truss blocks and keystone, and the openings in the crush plates;

first means for attaching the tensioning member to one of said tie plates;

second means for attaching the tensioning member to the other of said tie plates; and means for applying a tension force to said tensioning member to place the truss blocks, crush plates and keystone under compression;

a tie beam connected to and extending between said tie blocks, said roof structure including a plurality of spacer plates mounted on and supported by adjacent roof trusses to fill the voids between the roof trusses and thereby provide a decking for the roof structure.

15. A roof structure as recited in claim 14 wherein said rafter and the keystone are configured in an arc and the tie beam is a lower chord joining the arc at the foot ends of the rafters.

16. A structure comprising a truss, said truss including a plurality of truss blocks arranged in end to end relationship, each said truss block having a pair of end faces, a pair of side faces and top and bottom surfaces, and the truss blocks at each end of the truss defining the foot ends of the truss;

a plurality of crush plates, said crush plates being of malleable material and arranged such that a different one of said crush plates is sandwiched between each pair of adjacent truss blocks;

cooperable locking means on each said crush plate and the truss blocks engaged therewith for preventing the engaged truss blocks from slipping and twisting relative to one another;

a pair of tie blocks, one of said tie blocks disposed beneath and engaging the bottom surface of the truss block superposed thereon at one foot end of the truss and the other tie block disposed beneath and engaging the bottom surface of the truss block superposed thereon at the other foot end of said truss;

a pair of tie plates, one of said tie plates being disposed at one end of the truss in face-to-face contact with the truss block and the tie block at said one foot end and the other tie plate being disposed in face-to-face contact with the truss block and tie block at said other foot end of the truss, each said truss block having a channel in one side thereof extending inward a distance greater than one half of the width distance between the side faces of the truss block and said truss blocks being arranged such that the channeled sides of adjacent truss blocks face in opposite directions, each said crush plate having an opening therein which is in alignment with the channels formed in the truss blocks next adjacent thereto;

a tensioning member, each said tie plate having an opening therethrough for accommodating said tensioning member, said tensioning member extending through each opening in said tie plates, the channels formed in the truss blocks and keystone, and the openings in the crush plates;

first means for attaching the tensioning member to one of said tie plates;

second means for attaching the tensioning member to the other said tie plates; and means for applying a tension force to said tensioning member to place the truss blocks, crush plates and keystone under compression, said truss being adapted for use in the structure of a building.

* * * * *